United States Patent [19]

Vale

[11] 3,951,263

[45] Apr. 20, 1976

[54] HOLDERS FOR NEEDLES, PINS AND LIKE ARTICLES

[75] Inventor: Albert Hugh Vale, Cookhill, near Redditch, England

[73] Assignee: Abel Morrall Limited, England

[22] Filed: Apr. 14, 1975

[21] Appl. No.: 567,948

Related U.S. Application Data

[63] Continuation of Ser. No. 305,219, Nov. 10, 1972, abandoned.

[30] Foreign Application Priority Data

May 20, 1972 United Kingdom ..... 23862/72

[52] U.S. Cl. ..... 206/382

[51] Int. Cl.[2] ..... B65D 85/24

[58] Field of Search ..... 206/382, 383, 468, 380; 32/1; 220/41; 229/9

[56] References Cited

UNITED STATES PATENTS

| | | | |
|---|---|---|---|
| 222,107 | 11/1879 | Waters | 206/369 X |
| 337,893 | 3/1886 | Toof | 206/380 |
| 3,004,660 | 10/1961 | Hofmann | 206/382 |
| 3,396,833 | 8/1968 | Deneke | 206/382 |
| 3,444,995 | 5/1969 | Sanders | 206/382 |
| 3,500,998 | 3/1970 | Sanders | 206/382 |

FOREIGN PATENTS OR APPLICATIONS

| | | | |
|---|---|---|---|
| 1,236,064 | 6/1960 | France | 206/382 |
| 426,459 | 6/1967 | Switzerland | 206/382 |
| 19,130 | 1912 | United Kingdom | 206/382 |
| 457,855 | 12/1936 | United Kingdom | 220/41 |
| 551,131 | 2/1943 | United Kingdom | 229/9 |

*Primary Examiner*—Leonard Summer
*Attorney, Agent, or Firm*—Scrivener Parker Scrivener and Clarke

[57] ABSTRACT

A holder for needles and like articles both at the time of sale and for storage in subsequent use has a pad of felt through which the needles are pushed. Usually the pad is a block mounted on a generally flat base of vacuum formed plastics sheet with a backing sheet of card. A hollow in the plastics can provide a housing for the felt block and the needles can be pushed through both the plastics and the felt. A clear plastics cover over the needles can itself be bent to open the holder or the cover can be slidable on the base to expose a part of the base which is bendable to enable the needles to be gripped. Provision is made for closing the open end of the cover, retaining it in the closed position and limiting its opening movement.

9 Claims, 9 Drawing Figures

Figure 1:
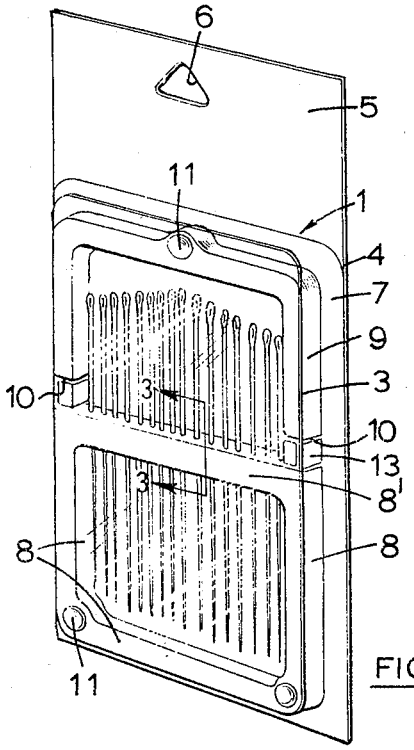

FIG. 6.
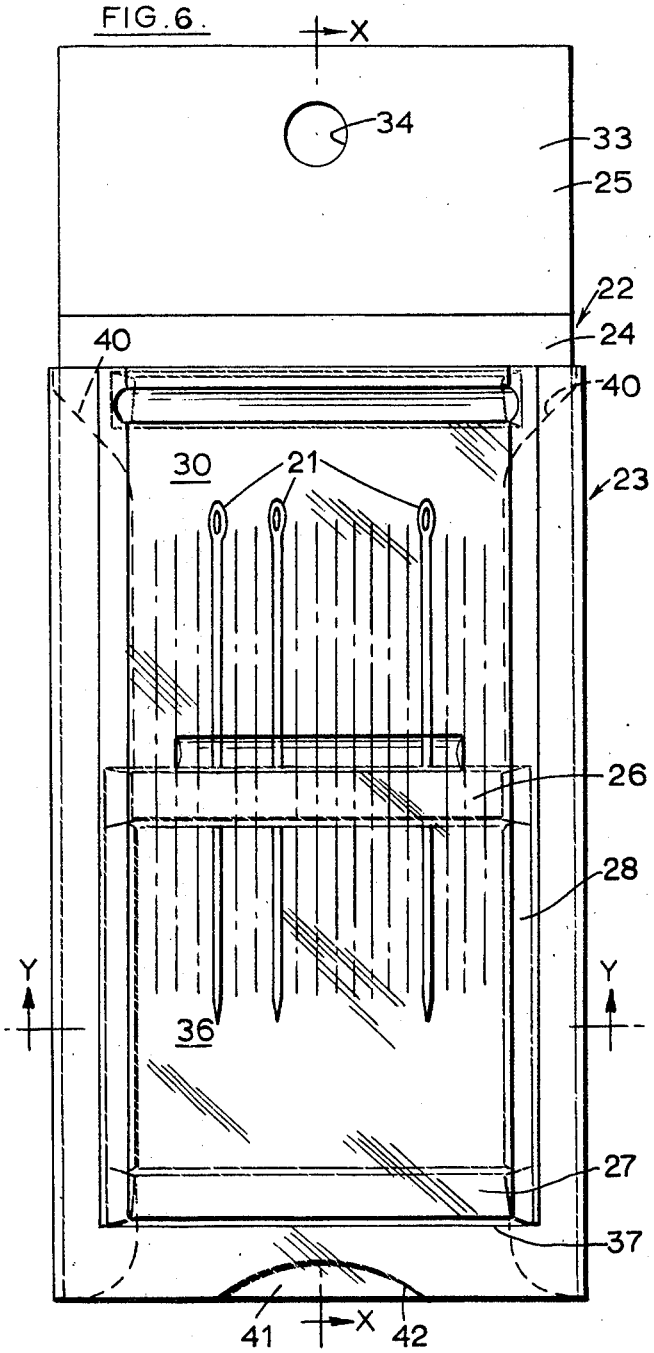
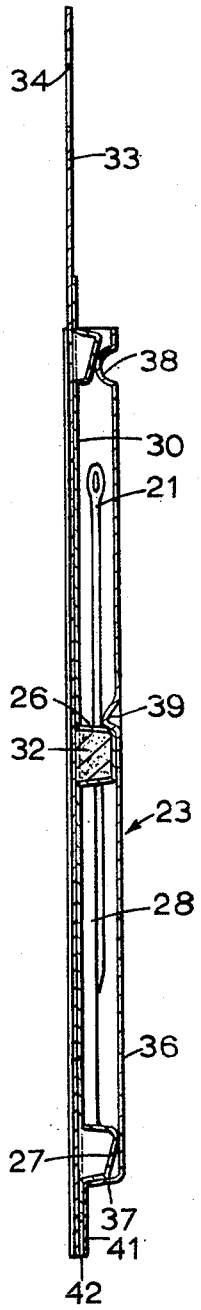
FIG. 7.

FIG. 8.
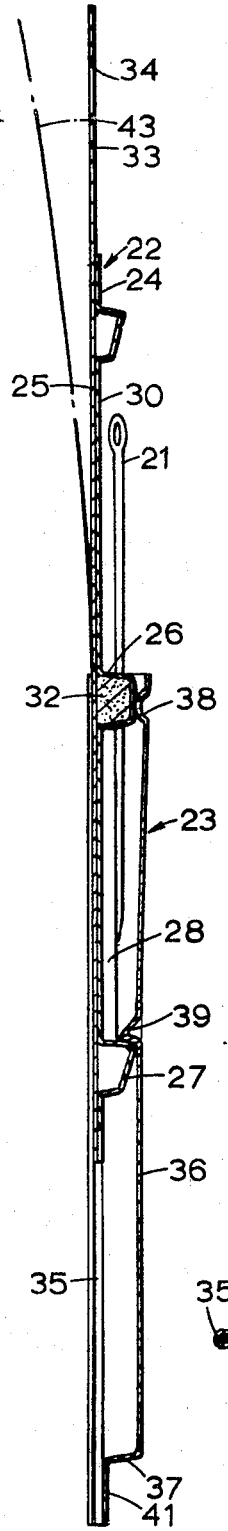
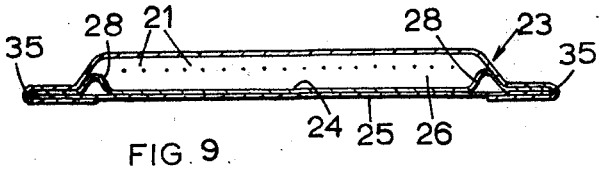
FIG. 9.

HOLDERS FOR NEEDLES, PINS AND LIKE ARTICLES

This is a continuation of application Ser. No. 305,219 filed Nov. 10, 1972, now abandoned.

This invention relates to holders for needles, particularly sewing needles, pins and like elongated articles of comparable size. Such articles often have pointed shanks and are usually sold in sets.

Such articles are normally packaged in holders for sale and the holders are used afterwards to store the articles in when they are not being used. For the purposes of neatness for sales appeal, and for ease of selection and access to them by the user after sale, it is convenient to arrange that the needles, pins and like articles are held side-by-side in rows in the holders.

A holder which is commonly used for sewing needles, for example, and in which the contents are so held in rows, is of book form. It comprises a card which is folded to form back and front flaps. The needles are commonly attached either to paper or to a piece of flannelette, coburg or like material affixed to the back flap. In some instances also the needles are attached to a combination of paper and material secured together. A window is usually provided in the front flap to enable the needles in the holder to be seen without necessarily having to open that flap. In the common arrangements in which the needles are attached either to paper or to material the shanks of the needles are usually threaded through the paper or material twice to hold the needles in place. Where the needles are attached to a combination of paper and material the needles are again often threaded through them twice, but occasionally when the needles are attached in groups in which the needles are close together the needles are threaded through the paper and material just once.

The arrangements in this book type of holder have disadvantages. One which is common to them all is that the insertion of the needles into the paper, material or the combination of paper and material is made awkward by the fact that their shanks have to be threaded through the paper and/or material, especially when, as is usual, the shanks have to be threaded through twice. In the paper arrangement, as a result of the initial insertion of the needles into the paper pairs of holes are formed in the paper, and it is usual to re-engage the needles in these holes each time afterwards that they are replaced in the holder after use. It is not always easy to locate the shank of a needle in the second hole of the pair of holes when it is threaded through the paper just once and it is appreciably more difficult to engage the shank in the further pair of holes when the shank is threaded through twice. Furthermore after the needles have been removed from and replaced in the holes a few times the holes become worn, and the paper adjacent the holes may even become torn, so that the needles are held in position less effectively. In the material form it is difficult to remove and replace needles without disturbing the others and rarely is it possible for the user to replace the needles in orderly rows, so that the needles look untidy in the holders.

Another form of known holder has a mounting which is moulded from plastics material and has formations formed in it to receive and grip the shanks of the needles, pins or other articles, to hold them in rows in the holders. This arrangement holds the articles neatly in rows, but it has the disadvantages that: the mountings have to be tailor-made for the articles they are to support, because of the formations; it is difficult to mould the mountings sufficiently accurately to ensure that the formations will grip the articles satisfactorily, and initial assembly of the articles in the mounting members before sale has its problems. Difficulty has been experienced in assembling them by machine because of the high degree of accuracy required to engage the articles in the formations, and as a result assembly has been carried out largely by hand, which is time consuming and costly. For protection of the articles it is preferable for them to be enclosed by the holders when stored therein. Whilst so enclosed it is also preferably that the holders should enable the articles to be seen without the necessity of opening the holders. Furthermore, it is desirable that for ease of selection of articles from the holders and access to the articles by the user, the articles should be positively supported in the holders against movement therein.

The present invention seeks to provide a holder which meets at least some of these requirements and to overcome at least some of the disadvantages of the known holders mentioned above.

One object of the invention therefore is to provide a holder for needles, pins and like pointed articles, which has a generally planar base with a hollow formation in a front surface thereof, and located in the hollow formation a mounting made of felt through which the points of the articles can be pushed to retain the articles in the holder by friction, a cover being attached to the base and being movable relative to the base between a closed position covering the mounting and an open position in which at least portions of articles held by the mounting in use are exposed for removal from the mounting.

By 'felt' is meant material made of matted fibres which are heavily compressed into a compact state, the fibres normally being natural fibres of wool or hair but possibly being synthetic fibres or a combination of natural and synthetic fibres.

Preferably the felt mounting is in the form of a pad transversely through which the needles or other articles can be passed to hold them in place. The pad may be rectangular, segmental or of any other convenient cross-section having a flank portion at which the needles or other articles can be inserted into the mounting.

A felt mounting is simple to produce and to apply to the holder, and articles can easily be inserted into the mounting and removed from it. Insertion of articles into the mounting merely involves pushing the points of the articles through it. The frictional grip which the felt applies ensures that the inserted articles are securely held in place. Furthermore, because of the nature of felt, articles which are inserted into the felt stay in the attitude in which they are left when they are released to leave them in the mounting. Therefore, not only is insertion faciliated but also neat, orderly arrangements of the articles can be readily achieved. This latter is an important advantage of using felt rather than, for example, resilient foam materials such as polyurathene foam or sponge rubber. Resilient foam material tends to deflect and resist penetration when an attempt is made to insert articles into it and although the articles may initially be arranged in an orderly fashion in the foam the elastic recovery of the foam after insertion can impair the original orderly arrangement.

The base of the holder may be cardboard, or stiff paper or plastics sheet. It may, if desired, be of book form. Alternatively the support may be made of plastics formed, for example by vacuum forming, or moulded, conveniently by injection moulding, to any required shape. The felt mounting may be located and secured inside a housing part of the base specially shaped to receive the mounting, or in a well in the base.

A further object of the present invention is to provide a holder for articles of the kind set forth comprising in combination: a generally planar and rectangular base formed from sheet material which is basically stiff but has some degree of resilience which permits temporary bending thereof, said base having a front surface at which there is a hollow formation extending transversely of two opposite sides of said base, a bendable portion capable of being manually deflected rearwards transversely of said two opposite sides by virtue of the resilience of said sheet material, and stiffening formations at said front surface which restrain said base from bending except to permit deflection of said bendable portion; a mounting for the articles on said base formed by a pad of flexible material able to be penetrated by and frictionally to grip the articles, and which said mounting is of complementary shape to and is located in said hollow formation, projects forwards from said front surface of said base, and is adapted to have the articles inserted therein, and hold the articles, side-by-side close to and substantially parallel to said front surface with portions of the articles overlying said bendable portion, and a cover attached to said base which extends over said front surface and is movable relative to said base between a closed position covering said mounting at which it engages with said bendable portion and prevents said portion from being deflected, and at which it defines with said base a container in which the articles held by said mounting in use are enclosed, and an open position at which at least the portions of the articles overlying said bendable portion are exposed for removal of the articles from said mounting, and said cover is disengaged from said bendable portion which is thereby able to be deflected rearwardly to facilitate access to the articles.

The base may be made of a plastics material or may comprise a front part made of such material. The plastics material may be of sheet or film form. Material such as is used in the manufacture of bubble packs may be used for example. The stiffening formations may be raised ribs in the plastics material. Even with the provision of the stiffening formations raised from the material the base will still be of substantially flat form.

Where the base comprises a front part made of a plastic material it may have a backing sheet of opaque sheet material such as carboard, or paper sheet secured to its back on which printed matter might be applied if desired. It is of course essential such a backing sheet does not prevent the base from being bent. The plastics material of which the front part is made will usually be uncoloured and transparent in which case the backing sheet may carry printed matter on its front face, that is the face to which the front part is attached. To increase the eye-appeal of the holder at least the front face of the backing sheet may be coloured. The backing sheet may extend over the whole of the back of the front part and hence it will necessarily have to be pliable to allow it to bend with the front part of the base. It may have an extension beyond the front part of the base to form a tab which may be provided with means for enabling the holder to be hung up. Such means may simply be an aperture to receive a hook or other supporting element.

The mounting may be made of felt. Conveniently it is of block-like from transversely through which the articles are passed to hold them in place. It may be rectangular, segmental or other appropriate cross-section affording flanks suitable for receiving the articles. A suitable hollow formation for the mounting may be provided, where the mounting is made of felt and the base or a front part of the base is made of plastics material, by the interior of a hollow blister, rib or other projection formed out of the material of the front part and protruding from the front of that part. In this arrangement the mounting is inserted into the formation from the back of the base, and preferably the formation is large enough to accommodate the mounting completely. When the base has a backing sheet as aforementioned the mounting is inserted in the formation before the backing sheet is secured to the front part, and when the backing sheet is applied it closes off the formation. The articles may be engaged with the mounting by pushing them through, so that they pierce, the wall of the formation, or openings may be left in the wall of the formation as the latter is formed, through which the articles can be passed to engage them in the mounting.

Preferably the cover is made of transparent sheet plastics material having channelled side portions at which it slidably engages with side edges of the base. The cover may be completely separable from the base to give access to articles held in the mounting. Interengageable formations or elements may be provided on the base part and cover which mate when the cover is in its closed position to locate the cover positively in that position. Similarly interengageable formations or elements may be provided to limit the opening movement of the holder.

Yet another object of the invention is to provide a sewing needle pack in which needles are mounted in a holder as herein provided.

Figure 2:
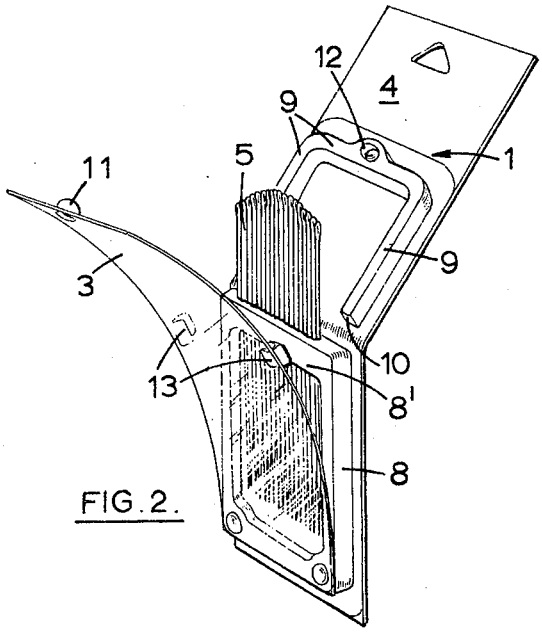
Figure 3:
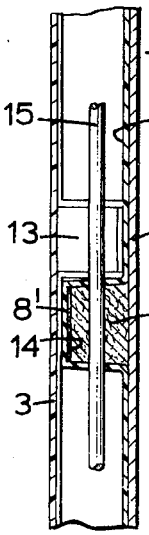
Figure 4:
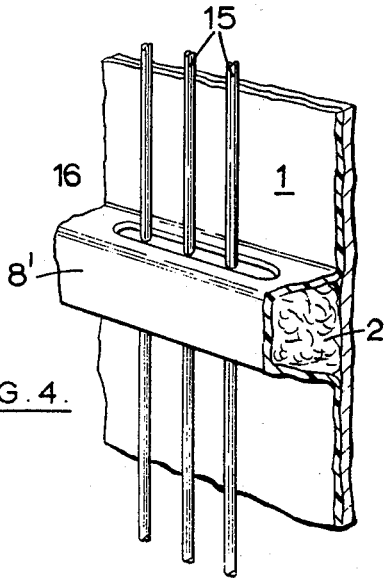
Figure 5:
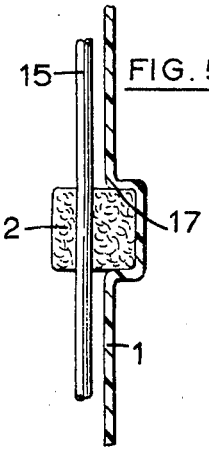

Embodiments of the invention will now be described by way of example with reference to the accompanying drawings in which:

FIGS. 1 and 2 are front perspective views of a sewing needle holder in accordance with the present invention, shown respectively in closed and open conditions, FIG. 3 is an enlarged fragmentary section on line 3—3 of FIG. 1, FIGS. 4 and 5, are fragmentary views showing possible modifications of the holder, FIG. 6 is a front elevation of a holder according to the invention showing the holder in the closed position, FIG. 7 is a section on line X—X of FIG. 6, FIG. 8 is a similar section to FIG. 7 but showing the holder in the open position, and FIG. 9 is a section on line Y—Y of FIG. 6.

The needle holder shown in FIGS. 1 to 3 of the accompanying drawings comprises a vacuum formed, transparent plastics support 1, a felt mounting 2, FIG. 3, located in the support 1, a transparent sheet plastics cover 3 releasably attached to the front of the support 1, and a card backing member 4 secured to the back of the support 1. The support 1 and backing member 4 are both oblong rectangular, being of similar width to one another but the backing member being longer than the support and being secured to the support such that is projects just at one end portion 5 from the support. In the projecting end portion 5 a hole 6 is pierced for enabling the holder to be hung on a hook or the like. With the cover 3 attached to the support 1 the holder has the general appearance of a bubble pack.

The support 1 has a continuous peripheral flange 7 by which it is sealed to the backing member 4. In one half of the support 1 remote from the projecting end portion of the backing member 4 there are four hollow rib formations 8, 8' which project from the front of the support 1 and are open at the back. These ribs 8, 8' are disposed in a rectangular configuration and they merge into one another at the corners of the rectangle. One rib 8' which lies adjacent the center of the support 1 and extends transversely of the support, forms a housing for the felt mounting 2. In the other half of the support 1 three further hollow rib formations 9, which also project from the front of the support and are open at the back, are disposed in a U-shaped configuration with the ribs 9 meeting one another at right angles, and the open side of the U being adjacent the housing rib 8'. The ribs 9 which are at the sides of the U and extend towards the housing rib 8' are aligned with the opposed ribs 8 extending from the housing rib 8' in the rectangular configuration. They stop short of the housing rib 8' so that gaps 10 are defined between the ends of the ribs 9 and the housing rib. Except for the ribs 8, 8' and 9 the support 1 is flat.

The two sets of ribs 8, 8' and 9 strengthen and stiffen the support 1, and the combined effect of these ribs and the backing member 8 is normally to retain the support in a flat condition as shown in FIG. 1. However, the gaps 10 between the two configurations of ribs define a natural fold line about which the part of the support containing the U-shaped configuration of ribs, together with the part of the backing member 4 behind it, can be bent backwards away from the plane of the rest of the support and backing member, as shown in FIG. 2. The resilience of the material of the support and of the backing member 4 restores them to the normal flat condition when the bending force is removed.

The cover 3 extends over the two configurations of ribs on the support 1. It has stud elements 11 which engage with sockets 12 in the ribs 8 and 9 to attach the cover 3 to the support. Two lugs 13 on the cover 3 are arranged to engage in the gaps 10.

In this embodiment the felt mounting 2 is in the form of a block-like pad which is inserted into the housing rib 8' from the back before the backing member 4 is applied to the support. It is completely contained in, and fills, the housing rib 8', as shown in FIG. 3. It is secured in place by adhesive 14 and is trapped in the housing rib 8' when the backing member is secured to the support. The adhesive 14 may be provided as an adhesive backing, say of self adhesive latex, on the mounting 2, or possibly as adhesive strips which are applied to surfaces of the mounting and housing rib and securely bound together when the surfaces are brought together. Instead of the adhesive 14, fastenings such as rivets or staples might perhaps be used to secure the mounting.

Needles 15 are engaged with the felt mounting 2 to locate them in the support 1 by pushing them through, so that they pierce, the flanks of the housing rib 8'. They are pushed into position from the side of the housing rib 8' adjacent the U-shaped configuration of ribs 9. When inserted, the heads of the needles lie within the confines of the U-shaped configuration of ribs, and the points lie within the confines of the rectangular configuration of ribs 8, 8'. The needles 15 lie side-by-side in the mounting, parallel to the flat part of the support 1 and to the backing member. The frictional grip which the felt of the mounting 2 applies on the needles 15 securely retains them in place in the mounting, and hence the support.

The needles may be assembled initially in the felt mounting 2 by machine using known apparatus and methods. In the drawings the needles 15 are shown inserted so that they are all spaced apart from one another in the mounting. They could alternatively be inserted in groups, the needles in each group being in touching contact with one another.

The felt used for the mounting 2 should be non-corrosive so that it will not have any harmful corroding effect on the needles it holds. If desired the felt may be treated with a suitable corrosion preventative. For preventing rust in steel needles the felt may be treated, for example, with a dilute solution of sodium benzoate.

In order to remove needles from the holder the cover 3 is detached either completely or partially, as shown in FIG. 2, from the support 1 and the part of the support containing the U-shaped configuration of ribs 9 is bent back to enable access to be gained readily to the needles required for use.

If desired, openings 16 as shown in FIG. 4 may be formed for the needles 15 in the flanks of the housing rib 8' during the course of the manufacture of the support. In the form shown in FIG. 4 the openings 16 are each large enough to receive several needles. They may alternatively be individual openings for each needle.

Instead of being fully contained in a housing rib as described above, the felt mounting 2 could be located in a well 17 formed in the support 1, as shown in FIG. 5. The well 17 is shallow so that a substantial part of the thickness of the mounting 2 projects out of the well at the front of the support, and is accessible for the needles 15 to be inserted directly into it.

The holder illustrated in FIGS. 6 to 9 is for holding sewing needles 21 and comprises a base 22 and a cover 23 slidably mounted on the base 22. The base 22 is of oblong rectangular shape and has a front part 24 and a backing sheet 25 secured to the back of the front part 24. The front part 24 is made of a clear plastics material which in the formed base part is of sheet or film form. The front part may for example be vacuum formed or moulded to shape. In one half of the front part 24 four raised hollow ribs 26, 27 and 28 are formed which project from a front face of the part 24 and are in a substantially square configuration. The ribs 26 and 27 extend transversely of the base. The rib 26 which is adjacent the transverse center line of the base is of generally rectangular outline in cross-section. The rib 27 which lies adjacent to one end edge of the base is of truncated wedge shape in cross-section. The other two, longitudinal ribs 28, which lie adjacent the opposite longitudinal edges of the base, are of generally triangular outline in cross-section and are smaller in cross-section than the ribs 26, 27. These ribs 26, 27 and 28 stiffen the base and serve to resist bending of that half of the base in which they are contained. Adjacent the other end of the base there is a further raised single hollow rib 29 projecting from and extending across the front part. This rib 29 is similar in cross-section to the rib 27 and serves to stiffen the other half of the base against bending of that portion of the base longitudinally of the base, that is about the longitudinal axis of the base. Between the rib 29 and the rib 26 the base is plain and forms a portion 30 which is bendable and can be bent or deflected rearwards.

The plastics material of which the front part 24 is made is sufficiently stiff to retain the part normally in a flat condition and to give the rib formations rigidity. It does, however, permit the plain portion 30 of the base to be bowed or deflected rearward by hand out of the general plane of the rest of the base, but it will urge that portion back to the normal flat condition when it is released.

Inserted into the hollow back of the transverse rib 24 is a mounting 32 formed by an oblong rectangular block of felt. The mounting fills the rib completely.

The backing sheet 5 is a rectangular card firmly attached to the front part 24. The card is of the same width as but longer than the base, and it is secured so that its one end portion 33 projects beyond that end of the front part adjacent to the single stiffening rib 29. A hole 34 is formed in the projecting end part of the card for the purpose of hanging the holder on a hook or other element. The card is thin and permits the desired bowing or deflection of the base mentioned above.

The card is secured to the front part after the mounting has been inserted into the rib 26 of the front part 24, so that it imprisons the mounting in the rib.

Needles 21 are engaged with the mounting 32 by pushing them through the wall of the rib 26 containing the mounting. The needles extend through the flanks of the rib 26 transversely of the mounting and parallel to the longitudinal axis of the base. They are securely held by the felt of the mounting. They lie close to and parallel to the front face of the base. The eyes of the needles are towards the rib 29.

The cover 23 of the holder is made from clear sheet plastics material. It is of oblong rectangular shape of similar size to the base. Its longitudinal edges are formed into narrow U-shaped channels 35 running the length of the cover 23 and with the open sides of the channels towards one another. These channels slidably engage with and closely embrace the longitudinal edges of the base 22. Adjacent the channels the cover is slopingly stepped longitudinally so that the central part 36 of the cover is raised from the level of the channels sufficiently to clear the rib formations on the base part in order that those formations will not interfere with sliding movement of the cover relative to the base part. When the cover is fitted to the base the stepped portions lie close alongside the outer flanks of the longitudinal ribs 28 of the base as shown in FIG. 9. Depending from the raised central part of the cover, at one end (the trailing end) of the cover, to the level of the channels is an end wall 37 which closes off the trailing end of the cover and also serves to stiffen the cover transversely. The other or leading end is open but its edge is stiffened by an internal, that is to say rearwardly projecting, hollow transverse rib 28 semicircular in cross-section. Near the middle of the cover is a shorter, internal rib 39 parallel to the rib 38 but of generally saw-toothed cross-section.

To assemble the base and cover together the trailing end of the base adjacent to the rib 27 is entered into the open, leading end of the cover so that its longitudinal edges engage in the channels 35. The end corners of the channels may be cut away as indicated at 40 to assist insertion of the base.

As the cross-section of the ribs 27 and 29 are of truncated wedge shape, the front faces of the ribs are inclined. The front face of the leading rib 29 is inclined towards the cover, that is to say away from the nearer end of the base. The front face of the trailing rib 27 is inclined towards the end of the base to which the rib 27 is adjacent.

After the corners of the base have been started in the channels 35, the base is slid further into the channels. In this direction the inclined face of the trailing rib 27 on the base allows the ribs 38 on the cover to ride easily over the rib 27. Similarly the inclined leading face of the saw-toothed cross-section rib 39 on the cover co-operates with the substantially parallel inclined front face of the rib 27 to enable the rib 39 to pass the rib 27. The curved surface of the rib 38 on the cover assists the rib 38 to ride over the rib 26 on the base in each direction of movement. The middle rib 39 on the cover is shallower than the rib 38 and though it makes contact with the rib 26 it can easily be caused to ride over the rib 26.

The two components are slid relative to one another until the cover 23 is fully drawn over the base 24. When this condition is reached the end wall 37 of the cover abuts the trailing rib 27 and prevents further relative movement of the components in the assembling direction. The leading rib 38 of the cover has in this position started to ride over the inclined front surface of the leading rib 29 of the base to an extent sufficient to close the otherwise open end of the cover 23. This is an advantage in reducing the entry of dust, particularly when the holder is on display for sale and is hanging vertically by the hole 34 with the leading end uppermost.

When the cover is in the closed position it completely overlies the needles in the mounting. The base and cover together define a closed container in which the needles are held, and can be seen through the cover.

In the closed condition of the holder a peripheral flange 41 on the cover adjacent the end wall 37 overlies the marginal portion of the base beyond the trailing end rib 27. A cut-out 42 in the marginal portion enables the flange 41 to be gripped between finger and thumb for opening the holder. Slight initial resistance to opening movement is imposed by the engagement of the middle rib 39 with the rib 26 on the base. This is sufficient to prevent the cover from sliding open under its own weight when the holder is hanging vertically as previously described, but can easily be overcome when the holder is being opened manually.

To gain access to the needles the cover and base are slid apart sufficiently to expose the portions of the needles which protrude from the side of the mounting 32 nearest to the leading rib 29, that is the eye-end portions of the needles. The plain bendable portion 30 of the base can then be deflected by hand backwards away from the needles as indicated by the dot-dash line 43 in FIG. 8, to enable the needles to be gripped more readily between finger and thumb for removal from the mounting.

A limit to the sliding opening movement of the holder is imposed by the engagement of the upright trailing flank of the saw-toothed cross-section middle rib 39 on the cover with the upright leading flank of the trailing rib 27 on the base.

I claim:

1. A holder for needles, pins and like elongated articles comprising in combination:

a generally planar base formed from sheet material which is basically stiff but has some degree of resilience for permitting temporary bending thereof, said base having a front surface, two opposite side edges, a medial elongated, forwardly projecting, hollow formation at said front surface for supporting the articles and which extends transversely relative to said side edges, and spaced first and second portions at opposite sides of said hollow formation, said first portion being formed with elongated forwardly projecting, hollow stiffening formations and comprising longitudinal stiffening formations adjacent to and extending longitudinally with respect to said side edges and a transverse stiffening formation extending transversely with respect to said side edges at a position spaced from said hollow formation, which said stiffening formations restrain said first portion from bending and in combination with said hollow formation define an enclosed area at said first portion, and said second portion being manually bendable rearwardly away from said hollow formation, and said hollow formation having opposed side walls which permit the articles to be inserted therethrough transversely of said hollow formation and locate the articles side-by-side close to, and substantially parallel to, said front surface with one end of the articles disposed in said enclosed area and the other end overlying said bendable portion, a cover for enclosing the articles located by said hollow formation in use, being made of substantially rigid sheet material and having a central portion which extends over said hollow formation and said first and bendable portions, and opposite marginal portions having opposed channels which engage around and are slidable along said side edge, said cover being slidable relative to said base longitudinally of said side edges between a closed position in which it overlies said enclosed area and said bendable portion and said channels engage with said side edges at said bendable portion and thereby prevent said portion from being deflected, and an open position in which said cover is withdrawn from said bendable portion whilst still overlying said enclosed area, so that the ends of the articles which overlie said bendable portion are exposed for removal of the articles from said hollow formation and said channels are disengaged from said bendable portion, which is thereby able to be deflected rearwardly to facilitate access to the articles, and means on said central portion co-operable with said hollow formation and said transverse stiffening formation for limiting the sliding movement of said cover relative to said base.

2. A holder for needles, pins and like elongated articles comprising in combination:

a generally planar base formed from sheet material which is basically stiff but has some degree of resilience for permitting temporary bending thereof, said base having a front surface, two opposite side edges, a medial elongated, forwardly projecting, hollow formation at said front surface extending transversely relative to said side edges, and spaced first and second portions at opposite sides of said hollow formation, said first portion being formed with elongated, forwardly projecting, hollow stiffening formations comprising longitudinal stiffening formations adjacent to and extending longitudinally with respect to said side edges and a transverse stiffening formation extending transversely with respect to said side edges at a position spaced from said hollow formation, which said stiffening formations restrain said first portion from bending and in combination with said hollow formation define an enclosed area at said first portion, and said second portion being manually bendable rearwardly away from said hollow formation, and said hollow formation having opposed side walls which permit the articles to be inserted therethrough transversely of said hollow formation, a mounting for the articles located in said hollow formation of complementary shape to said hollow formation, being formed by a pad of felt able to be penetrated by and frictionally to grip the articles inserted through said side walls so as to hold the articles side-by-side close to, and substantially parallel to, said front surface with one end of the articles disposed in said enclosed area and the other end overlying said bendable portion, a cover for enclosing the articles held by said mounting in use, being made of substantially rigid sheet material and having a central portion which is spaced forwards from and extends over said hollow formation and said first and bendable portions, and opposite marginal portions having opposed channels which engage around and are slidable along said side edges, said cover being slidable relative to said base longitudinally of said side edges between a closed position in which it overlies said enclosed area and said bendable portion and said channels engage with said side edges at said bendable portion and thereby prevent said portion from being deflected and an open position in which said cover is withdrawn from said bendable portion whilst still overlying said enclosed area, so that the ends of the articles which overlie said bendable portion are exposed for removal of the articles from said mounting and said channels are disengaged from said bendable portion, which is thereby able to be deflected rearwardly to facilitate access to the articles, and means on said central portion co-operable with said hollow formation and said transverse stiffening formation for limiting the sliding movement of said cover relative to said base.

3. A holder according to claim 2 wherein said enclosed area is rectangular and said stiffening formations are of elongated hollow rib form and extend along three sides of and meet at two adjacent corners of said area, and said hollow formation extends along the fourth side of said area parallel to said transverse stiffening formation.

4. A holder according to claim 3 wherein said transverse stiffening formation and said hollow formation project forwardly similar distances from said front surface and each has an inner flank which faces inwards into said enclosed area and an outer flank facing outwards away from said enclosed area, and said central portion of said cover is spaced from said front surface by a distance corresponding to the distance by which said transverse stiffening formation and hollow formation project from said front surface, and said central portion has a leading end adjacent to said bendable portion, a trailing end at which there is a rearwardly projecting end wall extending transversely between said marginal portions and projecting rearwards by a distance corresponding to the distance by which said central portion is spaced from said front surface, and intermediate said leading and trailing ends a rearwardly directed projection which is spaced from said wall by a distance corresponding to the distance between said outer flanks of said transverse stiffening formation and said hollow formation, projects rearwardly a shorter distance than the distance by which said wall projects rearwards from said central portion and is able to pass with interference over said hollow formation, said wall and said projection abutting when said cover is in said closed position respectively against said outer flank of said transverse stiffening formation and said outer flank of said hollow formation thereby to limit movement of said cover in the closing direction, and said projection abutting when said cover is in said open position against said inner flank of said transverse stiffening formation so as to limit the movement of said cover in the opening direction, said projection passing over said hollow formation as said cover is slid between said open and closed positions.

5. A holder according to claim 4 wherein said transverse stiffening formation has a forward surface which is inclined rearwardly from said inner flank to said outer flank of said stiffening formation, and said projection has a rearward surface confronting and substantially parallel to said inclined forward surface and a trailing flank substantially normal to said central portions facing towards said end wall of said cover, said forward surface and said rearward surface being adapted to co-operate with one another to assist initial assembly of said cover and said base.

6. A holder according to claim 4 wherein said bendable portion has a forwardly projecting stiffening formation extending transversely relative to said side edges of said base and spaced from said hollow formation, and said central portion of said cover has a rearwardly directed projection which extends transversely between said marginal portions adjacent said leading end and engages said stiffening formation at said second portion when said cover is in said closed position.

7. A holder according to claim 3 wherein said marginal portions of said cover slidingly engage with said longitudinal stiffening formations whereby said stiffening formations assist in guiding said cover in its sliding movement along said base.

8. A sewing needle pack comprising a holder and needles mounted in said holder, said holder comprising in combination:

a generally planar base formed from sheet material which is basically stiff but has some degree of resilience for permitting temporary bending thereof, said base having a front surface, two opposite side edges, a medial elongated, forwardly projecting, hollow formation at said front surface for supporting said articles and which extends transversely relative to said side edges, and spaced first and second portions at opposite sides of said hollow formation, said first portion being formed with elongated, forwardly projecting, hollow stiffening formations comprising longitudinal stiffening formations adjacent to and extending longitudinally with respect to said side edges and a transverse stiffening formation extending transversely with respect to said side edges at a position spaced from said hollow formation which said stiffening formations restrain said first portion from bending and in combination with said hollow formation define an enclosed area at said front portion, and said second portion being manually bendable rearwardly away from said hollow formation, and said hollow formation having opposed longitudinal, penetrable side walls, a mounting for said articles located in said hollow formation of complementary shape to said hollow formation, being formed by a pad of felt able to be penetrated by and frictionally to grip said articles, said needles being inserted into said mounting through said longitudinal side walls of said hollow formation and being held therein by the frictional grip of said felt side-by-side parallel to said opposite side edges of said base and close to and substantially parallel to said front surface with their pointed ends disposed in said enclosed area and their eye ends overlying said bendable portion, a cover for enclosing said articles held by said mounting, being made of substantially rigid sheet material and having a central portion which is spaced forwards from and extends over said hollow formation and said first and bendable portions, and opposite marginal portions having opposed channels which engage around and are slidable along said side edges, said cover being slidable relative to said base between a closed position in which it overlies said articles, said enclosed area and said bendable portion, and said channels engage with said side edges at said bendable portion and thereby prevent said portion from being deflected, and an open position in which said cover is withdrawn from said bendable portion, whilst still overlying said enclosed area, so that said eye ends of said needles are exposed for removal of said needles from said mounting and said channels are disengaged from said bendable portion, which is thereby able to be deflected rearwardly to facilitate access to said needles, and means on said central portion co-operable with said hollow formation and said transverse stiffening formation for limiting the sliding movement of said cover relative to said base.

9. A holder for needles, pin and like elongated articles comprising in combination:

a generally planar base formed from sheet material which is basically stiff but has some degree of resilience for permitting temporary bending thereof, said base having a front surface, two opposite side edges, a medial elongated, forwardly projecting, hollow formation at said front surface extending transversely relative to said side edges, and spaced first and second portions at opposite sides of said hollow formation, said first portion being formed with forwardly projecting, hollow stiffening formations comprising longitudinal stiffening formations adjacent to and extending longitudinally with respect to said side edges and a transverse stiffening formation extending transversely with respect to said side edges at a position spaced from said hollow formation, which said stiffening formations restrain said first portions from bending and in combination with said hollow formation define an enclosed area at said first portion, said second portion having a hinge part adjacent and parallel to said hollow formation about which said second portion is manually bendable rearwardly away from said hollow formation, and said second portion being formed with forwardly projecting, hollow stiffening formations which are spaced from said hollow formation and restrain said second portion from bending except at said hinge part, some of said stiffening formations in said two portions of said base having forwardly opening socket formations, and said hollow formation having opposed side walls which permit the articles to be inserted therethrough transversely of said hollow formation, a mounting for the articles located in said hollow formation of complementary shape to said hollow formation, being formed by a pad of felt able to be penetrated by and frictionally to grip the articles inserted through said side walls so as to hold the articles side-by-side close to, and substantially parallel to said front surface with one end of the article disposed in said enclosed area and the other end overlying said bendable portion, and a cover for enclosing the articles held by said mounting in use, being made of sheet material and being of similar shape to said base and extending over said hollow formation and said first and second portions, and having rearwardly protruding, stud projections which releaseably engage with said socket formations whereby said cover is detachably fastened to said base in a closed position in which it overlies said enclosed area and said second portion, said cover being releasable from said second portion so as to expose the ends of the articles which overlie said second portion for removal of the articles from said mounting and allow said second portion to be deflected rearwardly to facilitate access to the articles.

* * * * *